United States Patent [19]

Carter

[11] Patent Number: 4,898,409

[45] Date of Patent: Feb. 6, 1990

[54] TANDEM ROD FOR CASEMENT WINDOWS

[76] Inventor: Gregory G. Carter, 68 Weber Street South, Apartment 20, Waterloo, Canada, N2J 1Z7

[21] Appl. No.: 159,392

[22] Filed: Feb. 23, 1988

[51] Int. Cl.[4] ..... E05C 7/00

[52] U.S. Cl. ..... 292/31; 292/54

[58] Field of Search ..... 292/31, 30, 114, 336.3, 292/DIG. 30, DIG. 64, DIG. 60, 26, 24, 45, 54, 48, 241; 49/395; 29/434, 526.1; 248/295.1, 297.2, 297.3

[56] References Cited

U.S. PATENT DOCUMENTS

| | | | |
|---|---|---|---|
| 508,168 | 11/1893 | Dotey | 292/54 X |
| 528,059 | 10/1894 | Abrams | 292/54 |
| 1,306,598 | 6/1919 | Kunze | 292/26 X |
| 1,332,193 | 3/1920 | Anderson | 292/26 |
| 2,565,092 | 8/1951 | Reynaud | 292/DIG. 30 X |
| 2,893,666 | 7/1959 | Cousins | 248/295.1 X |
| 3,413,025 | 11/1968 | Sperry | 292/26 X |
| 4,095,829 | 6/1978 | Van Keompenburg | 292/26 X |
| 4,610,472 | 9/1986 | Billingsley | 292/54 |
| 4,674,777 | 6/1987 | Guelck | 292/101 |
| 4,674,780 | 6/1987 | Weinerman et al. | 292/336.3 |

FOREIGN PATENT DOCUMENTS

| | | | |
|---|---|---|---|
| 32666 | 12/1907 | Fed. Rep. of Germany | 292/31 |
| 2403441 | 5/1979 | France | 292/DIG. 60 |
| 63028 | 10/1938 | Norway | 292/31 |

*Primary Examiner*—Joseph Falk
*Assistant Examiner*—Jose V. Chen
*Attorney, Agent, or Firm*—Daryl W. Schnurr

[57] ABSTRACT

A tandem rod for use between locking ends of locking handles on a casement window or the like has an elongated bar with two or more brackets slidable thereon. The bar does not have any pre-existing openings by which the brackets can be affixed to the bar. The potential sites for affixing the first bracket onto the bar are infinite. The locking handles can be installed in a window first at any desired location and the tandem rod can then be fitted to the existing location of the locking handles. The tandem rod overcomes the difficulty of installation of previous tandem rods in which the locking handles must be located at pre-determined locations in the bar.

15 Claims, 4 Drawing Sheets

TANDEM ROD FOR CASEMENT WINDOWS

BACKGROUND OF THE INVENTION

1. Field of the Invention

This invention relates to a tandem rod for use with locking handles on a casement window or the like so that all handles move simultaneously with the movement of any one handle.

2. Description of the Prior Art

Tandem rods are known for use on casement windows but previous tandem rods are inflexible and are difficult to install properly. One type of known tandem rod has two pre-existing openings one at each end of the rod. The rod is intended to interconnect the locking ends of two locking handles. Since the openings in the rod are in a fixed location, the locking handles must be installed a precise distance from one another so that when the locking handles are in the same position (eg. both open or both closed) the distance between openings in the ends of the locking handles that are designed to be connected to the tandem rod must be exactly equal to the distance between the two openings on the tandem rod. If the locking handles are not precisely located, then one of the handles will remain partially opened when the other handle is fully closed or one handle will remain partially closed when the other handle is fully opened, thereby defeating the purpose of the locking handle on the window. In practice, it is extremely difficult to properly locate the locking handles at a distance that precisely corresponds to the distance between two pre-existing openings on the tandem rod. Often, during installation, the locking handles must be moved slightly to a new location after they are first installed in order to more closely fit with the tandem rod. This can result in a shoddy appearance to the window or necessitate repairs to the window. Existing tandem rods are not widely used because of the difficulty in properly installing them. Often, window installers will install casement windows with two or more locking handles without installing any tandem rod whatsoever. In this way, a consumer is deprived of the benefits of the tandem rod as it can be very difficult to close or open a casement window while attempting to turn the window crank with one hand and try to open or close the other two locking handles simultaneously with the other hand. When the locking handles are not opened or closed simultaneously, the window can tend to jam against one of the locking handles and prevent it from being opened or closed.

SUMMARY OF THE INVENTION

It is an object of the present invention to provide a tandem rod that can be properly installed between pre-existing locking handles on a casement window, the tandem rod providing infinite locations for the attachment of the locking handles. It is a further object of the present invention to provide a tandem rod that can be used on a casement window where the locking handles can be installed in the windows first at any desired location and the tandem rod can be made to fit with the location of the locking handles.

A tandem rod for use between locking ends of locking handles on a casement window so that all of said handles move simultaneously with the movement of any one handle, said locking ends having suitable openings therein, has an elongated bar with at least two brackets, being a first bracket and a second bracket, located thereon. The bar has two ends and there is a plurality of brackets for a plurality of locking handles for said window. The brackets and the bar have corresponding male and female shapes thereon so that the brackets can slide to any desirable location along the bar but cannot be removed therefrom except at said ends. Each bracket has a passageway located therein normal to said bar, the passageway being shaped to receive a screw. In a final assembled state, the screw passes through a suitable opening in the locking end of one of said locking handles through said passageway and of being fixedly and penetratingly secured in said bar at a location thereon, thereby interconnecting said locking handle (and bar) and affixing said bracket on a particular location on said bar. When the bracket is affixed on a particular location on said bar, the bracket is no longer slidable relative to said bar. There is one bracket and one locking handle affixed to said bar at each location of a locking handle. The locking handle being able to pivot about the screw. The location of the locking handle determines the location of the affixed bracket. There are no pre-existing openings in said bar to receive the screw prior to the penetration of the screw for a particular bracket. potential sites for affixing the first bracket to said bar are infinite and potential sites for affixing the second bracket to said bar are infinite except for the location of said first bracket.

In a method of installing a tandem rod between locking ends of at least two locking handles installed on a casement window where all of said handles move simultaneously with the movement of one handle, the tandem rod has an elongated bar and at least two brackets that can be mounted on said bar. The bar has two ends and at least two brackets that can be slidably mounted on said bar. There is one bracket for each locking handle of said window. The brackets and the bar have corresponding male and female shapes thereon so that the brackets can slide to any desirable location along the bar but cannot be removed therefrom except at said ends. Each bracket has a passageway located therein normal to said bar, the passageway being shaped to receive a screw. The screw is capable of passing through a suitable opening in the locking end of one of said locking handles, through said passageway and being fixedly secured in said bar at any location thereon so that the locking handle can pivot about said screw. A method comprises the steps of choosing a bar of sufficient length to extend between all of said locking handles for said window, sliding a first bracket onto said bar, lining up said bar with said locking handles so that said bar extends between all of said handles, maintaining said bar in said position, inserting a screw through an opening in the locking end of one of said handles and into said passageway of a bracket, turning the screw within said passageway into said bar until said bracket and said locking handle is affixed to said bar so that said locking handle is able to pivot about said screw, sliding a second bracket onto said bar, inserting a second screw through an opening in the locking end of a second locking handle and into said passageway of said slider, turning said second screw into said second bracket and into said bar, affixing said second bracket and second locking handle to said bar in the same manner as said first bracket, repeating the same steps for any additional brackets and locking handles that are installed in said casement window.

A tandem rod and locking handles in combination has locking handles that are mounted on a casement window or the like so that all handles move simultaneously with the movement of any one handle. The combination is characterized by a tandem rod and locking handles, the tandem rod having an elegant bar with at least two brackets, being a first bracket and a second bracket, located thereon. There is one bracket for each locking handle of said window and at least two locking handles. The brackets in said bar have corresponding male and female shapes thereon so that the brackets can slide to any desirable location along the bar but cannot be removed therefrom except at said ends. Each bracket has a passageway which is shaped to receive a screw. The screw is capable of passing through the suitable opening in the locking end of one of said locking handles, through said passageway and of being fixedly and penetratingly secured in said bar at any location thereon, thereby interconnecting said locking handle, bracket and bar and affixing said bracket at a particular location on said bar. The bracket is no longer slidable relative to said bar and the locking handle is able to pivot about said screw. One bracket and one locking handle are affixed to said bar at each location of a locking handle. The location of the locking handle determines the location of the affixed bracket. There are no pre-existing openings in said bar to receive said screw prior to the penetration of a particular screw for a particular bracket. Potential sites for affixing the first bracket to said bar are infinite and potential sites for affixing the second bracket to said bar are infinite except for the location of said first bracket.

DESCRIPTION OF A PREFERRED EMBODIMENT

Figure 1:
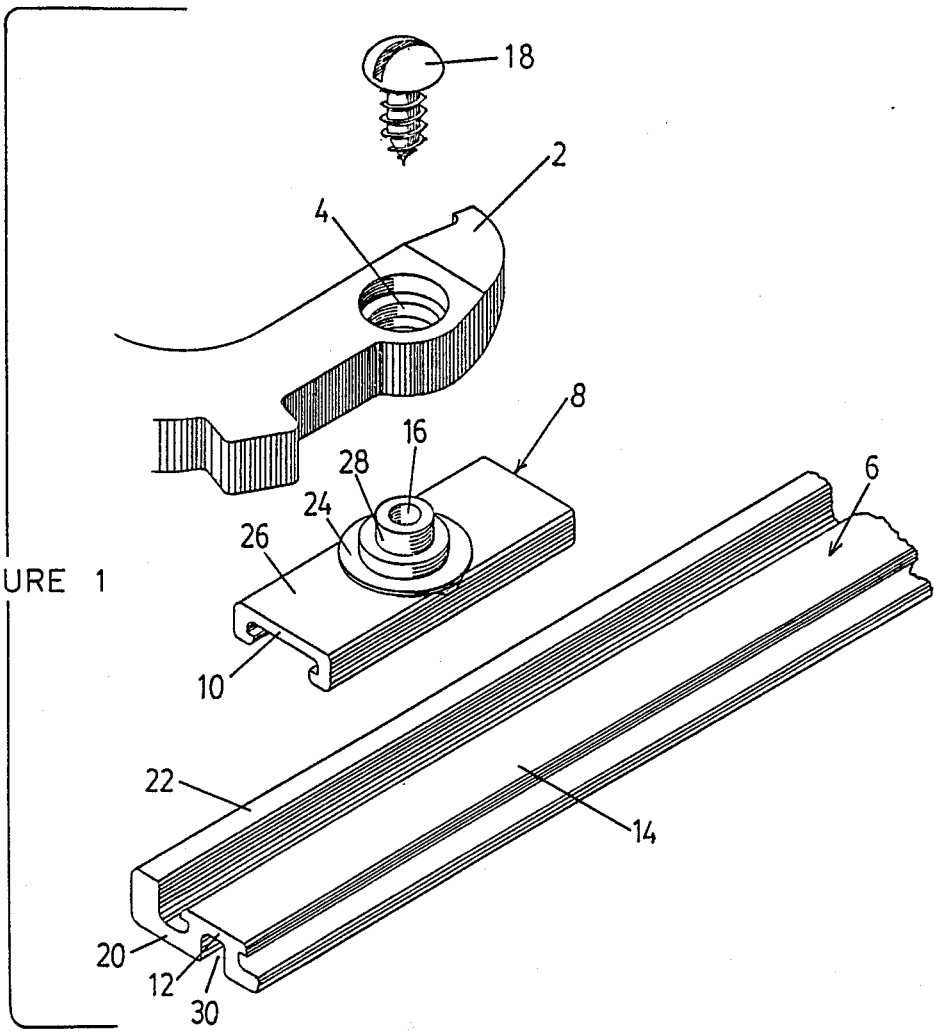
In FIG. 1 there is shown a partial perspective exploded view of a tandem rod and locking end of a locking handle.

Referring to the drawings in greater detail, in FIG. 1, the partial view of a locking end 2 of a locking handle (not shown) has an opening 4 therein. An elongated bar 6 (partially shown) and a bracket 8 together form a tandem rod. It can readily be seen that the bracket 8 has a C-shaped cross-section 10 that is formed in a female shape so that the bracket can be inserted over an end 12 and onto a C-shaped ridge 14 of the bar 6. The ridge 14 is formed into a male shape corresponding to the shape of the bracket 8 so that the bracket 8 will slide to any desirable location along the bar 6 but the bracket 8 cannot be removed from the bar 6 except at either end 12 (only one of which is shown in FIG. 1).

There is one bracket 8 for each locking handle of the casement window and there are at least two brackets 8 on each bar 6. The bracket 8 has a passageway 16 located therein normal to said bar 6. The passageway 16 is shaped to receive a screw 18 which is a tapping screw. The screw is capable of passing through the opening 4 in the locking end 2 of the locking handle through the passageway 16 and being fixedly secured in the bar 6 at any location thereon. When the screw is so inserted, the locking handle 2, bracket 8 and bar 6 are interconnected and are affixed at a particular location on said bar 6 with the locking handle being able to pivot about said screw. The bracket 8 is then no longer able to slide relative to the bar 6. One bracket and one locking handle are affixed to said bar 6 at each location of a locking handle on said casement window (not shown).

Prior to the penetration of the screw 18 into the bar 6, there are no pre-existing openings in said bar 6 to receive said screw but a bracket 8. The potential sites for affixing the first bracket 8 to said bar 6 are infinite. The potential sites for affixing a second bracket to said bar are infinite except for that location occupied by the first bracket.

The materials of the bar 6 and bracket 8 and the cross-sectional size and length of the passageway 16 relative to the size of the screw 18 are such that the screw can easily be made to penetrate and become fixedly secured to said bar. The passageway does not have a preformed screw thread therein and the cross-sectional size of the passageway is slightly smaller than the cross-sectional size of the screw 18 (being the maximum outside diameter of the screw threads) so that the screw will cut its own screw thread into the passageway.

Figure 2:
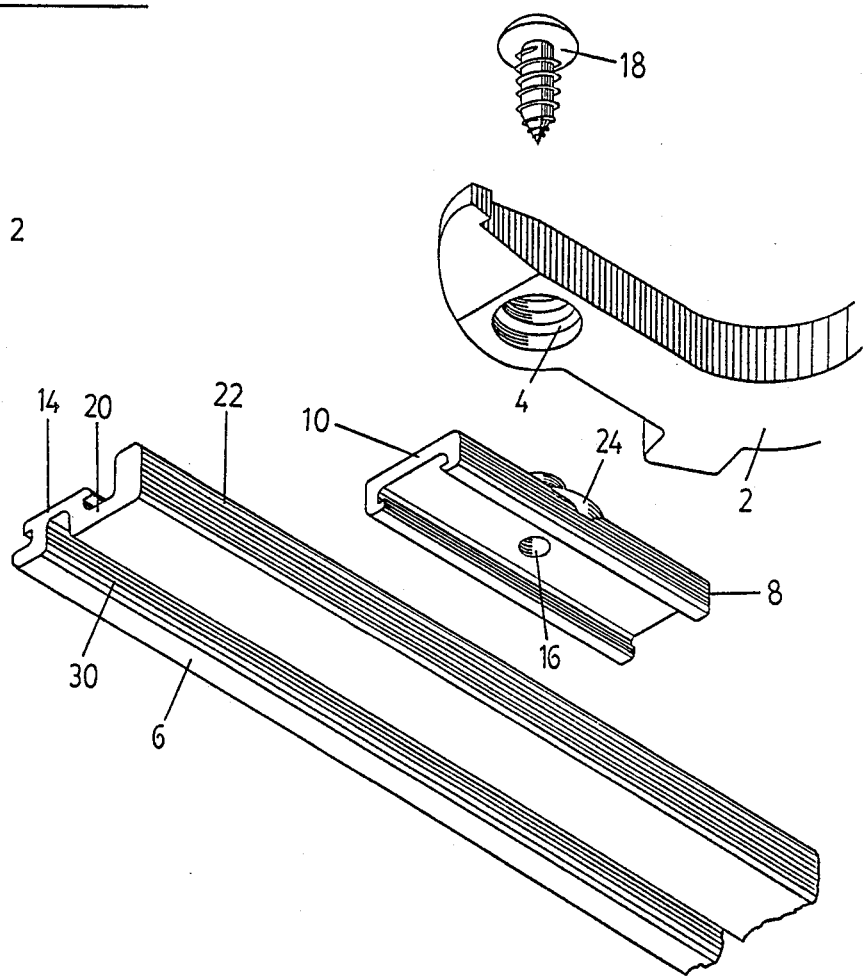
FIG. 2 is a partial perspective exploded view of a tandem rod and the locking end of the locking handle when viewed from beneath the tandem rod.

The bar 6 shown in FIGS. 1 and 2 has a base 20 extending beneath said ridge 14 and a flange 22 extending from said base 20 adjacent to said ridge 14. The flange provides strength to the bar 6 and also provides the user with something to hang onto during the installation of the rod. The flange could be omitted if desired.

A nib 24 surrounds the passageway 16 on a side 26 of said bracket 8 opposite to said bar 6. The nib 24 has a cylindrical shape and is sized at a free end 28 thereof to fit partially within the opening 4 of the locking handle 2. When the tandem rod is installed on a locking handle, the free end 28 fills the smallest part of the opening 4 and the locking handle pivots about the screw and the free end 28. The nib 24 provides strength to the bracket 8 but also provides a sufficient foundation for the screw 18 so that the screw can easily be made to penetrate the rod. If the passageway 16 is too large or the nib is too small, the threads formed in the passageway by the screw could tear before the screw penetrated the bar 6 and it would then be very difficult to make the screw penetrate the bar. The bracket and bar are preferably designed sio that the threads formed in the bracket have sufficient strength to tap the screw into the bar. When the screw penetrates the bar, it creates its own threads in the bar and tears the threads in the bracket.

Once the screw is inserted into the bar a free end of the screw does not extend beyond a channel 30 in the bar 6. Preferably the overall depth of the bar with the bracket installed thereon (excluding the nib) does not exceed six millimeters.

Figure 3:
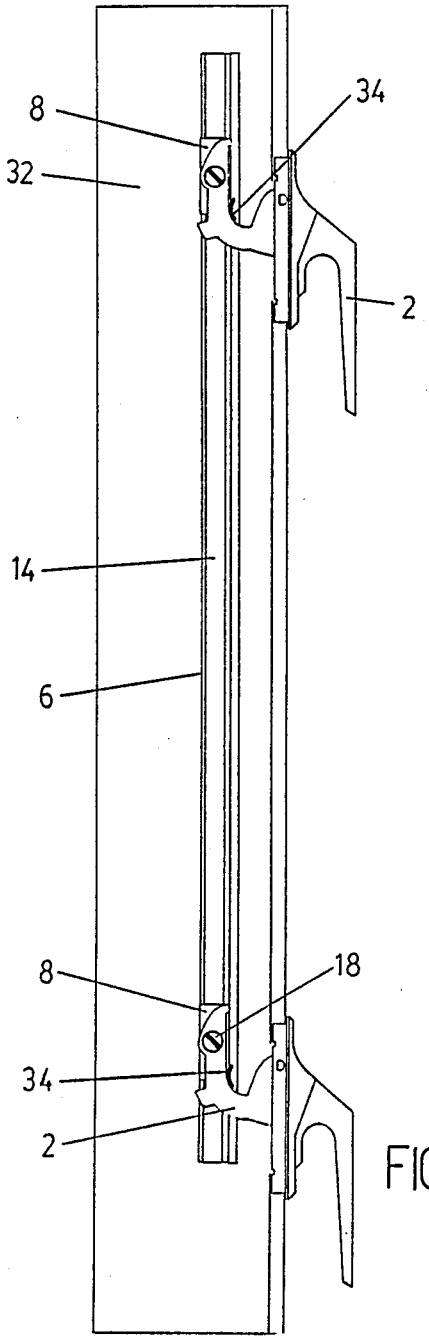
FIG. 3 is a schematic partial side view showing the tandem rod installed between the locking ends of two locking handles in a locked position on a casement window.
Figure 4:
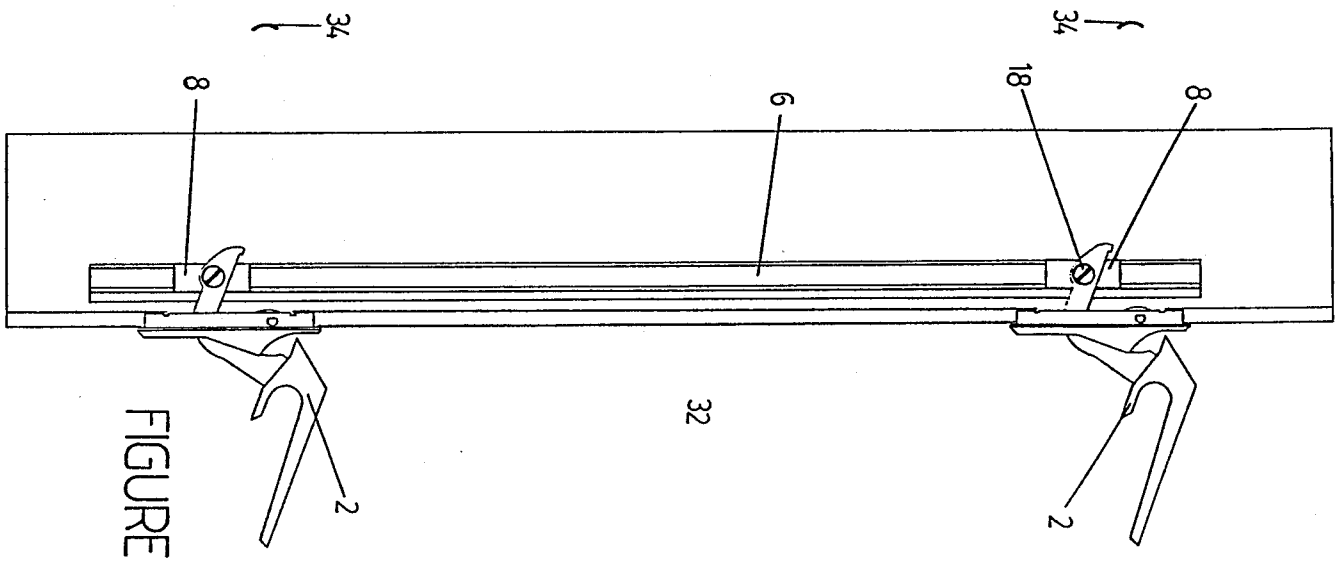
FIG. 4 is a schematic partial side view showing the tandem rod installed between the locking ends of two locking handles in an unlocked position on a casement window.

In FIGS. 3 and 4, the tandem bar 6 and two brackets 8 are shown installed between two locking handles 2. The locking handles 2 are installed in a window 32 having two keepers 34, which are depicted schematically. The keepers 34 are mounted in a window frame (not shown). In FIG. 3, the locking handles 2 and window 32 are shown in a closed position and in FIG. 4, the locking handles 2 and window 32 are shown in an open position. It can readily be seen that when one locking handle is moved manually from one position to another, the other locking handle will move simultaneously each locking handle pivoting about the screw.

One advantage of the tandem rod of the present invention is that the locking handles can be installed in the window first without paying any attention to their precise location relative to the tandem rod. The locking handles are then all moved to the same position, and preferably to the closed position. The elongated bar is then connected to the locking handle so that it extends between all of said handles. The bar is maintained in that position and a first bracket is slid onto the bar. A screw is inserted through an opening in the locking end of one of the locking handles into the passageway of the first bracket and is turned within the passageway into said bar so that it affixes said bracket and said locking handle to said bar at a particular location. A second bracket is then slid onto the bar and a second screw is inserted through an opening in the locking end of a second locking handle and into the passageway of said second bracket. The second screw is then turned into the second bracket and into the bar, thereby affixing the second bracket and second locking handle to said bar. The procedure is repeated for any other locking handles on said casement window.

Since the potential sites for locating the first bracket on the bar are infinite and since the potential sites for locating the second and subsequent brackets are infinite except for the location of the first bracket, the tandem rod can be made to fit the existing location of the locking handles. Therefore, it is a relatively simple manner to properly install the tandem rod so that when one locking handle is fully open, all locking handles are fully open and when one locking handle is closed, all locking handles are closed. In this manner, the casement window can be smoothly opened and closed and when the locking handles are in a closed position, the window is effectly sealed from outside air.

A second advantage of the tandem rod of the present invention is that the number of stock sizes for the lengths of the elongated bar can be reduced. The elongated bar can be made of virtually any suitable material but is preferably selected from the group of extruded fibreglass, zinc-coated steel, stainless steel or aluminum and is still more preferably aluminum. The brackets, including the nibs, can also be made of any suitable material but are preferably selected from the group of nylon or plastic. Obviously, if plastic is chosen, it must be of the type that is somewhat flexible so that the bracket will not break when the screw is tightened.

While the tandem rod is described in detail for use in association with a casement window, it can be used for other windows that operate in a manner similar to a casement window, for example an awning window.

What I claim as my invention is:

1. A tandem rod for use between locking ends of locking handles on a casement window or the like so that all of said handles move simultaneously with the movement of any one handle, said locking ends having suitable openings therein said tandem rod comprising an elongated bar having two ends with at least two brackets, being a first bracket and a second bracket, located thereon, there being a plurality of brackets for a plurality of locking handles for said window, said brackets and said bar having corresponding male and female shapes thereon so that the brackets can slide to any desirable location along the bar but cannot be removed therefrom except at said ends, a screw each bracket having a passageway being shaped to receive said screw, and in a final assembled state said screw passes through a suitable opening in the locking end of one of said locking handles, through said passageway and being fixedly and penetratingly secured in said bar at a location thereon, thereby interconnecting said locking handle, bracket and bar and affixing said bracket at a particular location on said bar, the bracket no longer being slidable relative to said bar, the locking handle being able to pivot about said screw, one bracket and one locking handle being affixed to said bar at each location of a locking handle, the location of the locking handle determining the location of the affixed bracket, there being no pre-existing openings in said bar to receive said screw prior to the penetration of a screw for a particular bracket, potential sites for affixing the first bracket to said bar being infinite before said final assembled state, potential sites for affixing the second bracket to said bar being infinite except for the location of said first bracket.

2. A tandem rod as claimed in claim 1 wherein the materials of the bar and bracket and the cross-sectional size and length of said passageway relative to the size of said screw is such that the screw can easily be made to penetrate and become fixedly secured to said bar.

3. A tandem rod as claimed in claim 2 wherein the brackets have the female shape and the bar has the male shape.

4. A tandem rod as claimed in claim 3 wherein the screw is a tapping screw and the passageway does not have a pre-formed screw thread therein, the cross-sectional size of the passageway being slightly smaller than the cross-sectional size of said screw.

5. A tandem rod as claimed in claim 4 wherein the material of the bar is selected from the group of steel, extruded fibreglass, zinc-coated steel, stainless steel or aluminum.

6. A tandem rod as claimed in claim 5 wherein the material for the bracket is selected from the group of nylon or plastic.

7. A tandem rod as claimed in claim 4 wherein the bracket has a C-shaped cross-section and the bar has a C-shaped ridge that fits within said C-shaped cross-section.

8. A tandem rod as claimed in claim 7 wherein the bar has a base extending beneath said ridge and a flange extending from said base adjacent to said ridge.

9. A tandem rod as claimed in claim 8 wherein a nib surrounds the passageway on a side opposite to the bar.

10. A tandem rod as claimed in claim 9 where the nib has a cylindrical shape and it is sized at a free end thereof to fit partially within the opening of the locking end of the locking handle.

11. A method of installing a tandem rod between locking ends of at least two locking handles installed on a casement window so that all of said handles move simultaneously with the movement of one handle, said tandem rod having an elongated bar with two ends and at least two brackets that can be slidably mounted on said bar, there being one bracket for each locking handle of said window, said brackets and said bar having corresponding male and female shapes thereon so that the brackets can slide to any desirable location along the bar but cannot be removed therefrom except at said ends, each bracket having a passageway located therein normal to said bar, said passageway being shaped to receive a screw, said screw being capable of passing through a suitable opening in the locking end of one of said locking handles, through said passageway and being fixedly secured in said bar at any location thereon so that the locking handle can pivot about the screw, said method comprising the steps of choosing a bar of sufficient length to extend between all of said locking handles for said window, sliding a first bracket onto said bar, lining up said bar with said locking handles so that said bar extends between all of said handles, maintaining said bar in said position, moving all locking handles to the same position and maintaining them in that position, inserting a screw through an opening in the locking end of one of said locking handles and into said passageway of a bracket, turning the screw within said passageway into said bar, thereby affixing said bracket and said locking handle to said bar so that said locking handle is able to pivot about said screw, sliding a second bracket onto said bar, inserting a second screw through an opening in the locking end of a second locking handle and into said passageway of said bracket, turning said second screw into said second bracket and into said bar, thereby affixing said second bracket and second locking handle to said bar in the same manner as said first bracket, repeating the same steps for any additional brackets and locking handles, if any are installed in said casement window.

12. A tandem rod and locking handles in combination, said locking handles being mounted on a casement window or the like so that all handles move simultaneously with the movement of any one handle, said combination comprising a tandem rod and locking handles, and a screw, said tandem rod having an elongated bar with at least two brackets, being a first bracket and a second bracket located thereon, there being one bracket for each locking handle of said window and at least two locking handles, said brackets and said bar having corresponding male and female shapes thereon so that the brackets can slide to any desirable locating along the bar but cannot be removed therefrom except at said ends, each bracket having a passageway being shaped to receive said screw, each locking handle having a suitable opening in the locking end thereof, and in a final assembled state said screw passes through the suitable opening in the locking end of one of said locking handles, through said passageway and being fixedly and penetratingly secured in said bar at a location thereon, thereby interconnecting said locking handle, bracket and bar and affixing said bracket at a particular location on said bar, the bracket no longer being slidable relative to said bar, the locking handle being able to pivot about said screw, one bracket and one locking handle being affixed to said bar at each location of a locking handle, the location of the locking handle determining the location of the affixed bracket, there being no pre-existing openings in said bar to receive said screw prior to the penetration of a screw for a particular bracket, potential sites for affixing the first bracket to said bar being infinite before said final assembled state and potential sites for affixing the second bracket to said bar being infinite except for the location of said first bracket.

13. A tandem rod as claimed in claim 12 wherein the materials of the bar and bracket and the cross-sectional size and length of said passageway relative to the size of said screw is such that the screw can easily be made to penetrate and become fixedly secured to said bar.

14. A tandem rod as claimed in claim 13 wherein the screw is a tapping screw and the passageway does not have a pre-formed screw thread therein, the cross-sectional size of the passageway being slightly smaller than the cross-sectional size of said screw.

15. A tandem rod as claimed in claim 14 wherein the bracket has a C-shaped cross-section and the bar has a C-shaped ridge that fits within said C-shaped cross-section.

* * * * *